US011028794B2

(12) United States Patent
Waite, III et al.

(10) Patent No.: US 11,028,794 B2
(45) Date of Patent: Jun. 8, 2021

(54) METHOD TO ELEVATE IDLE SPEED TO LAUNCH A VEHICLE WITH MANUAL TRANSMISSION

(71) Applicant: PACCAR Inc, Bellevue, WA (US)

(72) Inventors: Burton Edwin Waite, III, Bellingham, WA (US); Charles Wayne Reinhardt Swart, Bellingham, WA (US)

(73) Assignee: PACCAR INC., Bellevue, WA (US)

( * ) Notice: Subject to any disclaimer, the term of this patent is extended or adjusted under 35 U.S.C. 154(b) by 0 days.

(21) Appl. No.: 15/999,695

(22) Filed: Aug. 20, 2018

(65) Prior Publication Data

US 2019/0234332 A1 Aug. 1, 2019

Related U.S. Application Data

(63) Continuation of application No. 15/170,599, filed on Jun. 1, 2016, now Pat. No. 10,054,073.

(51) Int. Cl.

| | |
|---|---|
| ***F02D 41/08*** | (2006.01) |
| ***F02D 29/02*** | (2006.01) |
| ***F02D 41/02*** | (2006.01) |

(52) U.S. Cl.

CPC ..... *F02D 41/08* (2013.01); *F02D 29/02* (2013.01); *F02D 41/022* (2013.01); *F02D 2200/501* (2013.01); *F02D 2200/602* (2013.01)

(58) Field of Classification Search

CPC ... F02D 41/08; F02D 2200/501; F02D 41/022
See application file for complete search history.

(56) References Cited

U.S. PATENT DOCUMENTS

| | | | | |
|---|---|---|---|---|
| 4,829,433 | A * | 5/1989 | Nakano | F16H 61/66259 192/221 |
| 5,863,277 | A | 1/1999 | Melbourne | |
| 6,274,944 | B1 * | 8/2001 | Letang | F02D 41/083 123/331 |
| 6,634,984 | B1 | 10/2003 | Doering et al. | |
| 7,104,924 | B2 * | 9/2006 | Hawkins | F02D 41/083 477/111 |
| 7,165,530 | B2 | 1/2007 | Jensen et al. | |
| 8,224,544 | B2 * | 7/2012 | Sah | B60W 10/115 701/68 |
| 8,480,005 | B2 * | 7/2013 | Dame | B60H 1/00885 123/339.14 |
| 9,056,604 | B2 | 6/2015 | Lochocki, Jr. et al. | |
| 2015/0239456 | A1 * | 8/2015 | Liggins | B60W 30/18027 701/37 |

FOREIGN PATENT DOCUMENTS

| | | |
|---|---|---|
| EP | 0 697 509 A2 | 2/1996 |

* cited by examiner

*Primary Examiner* — Sherry L Estremsky

(57) ABSTRACT

A method of controlling an idle speed for an engine of a vehicle includes the steps of sensing a vehicle speed. At least one of a parking brake position and a clutch position is also sensed. When it is determined that the vehicle speed is below a maximum vehicle speed, and either the parking brake is released or the clutch is depressed, the engine idle speed is increased from a base idle speed to a launch idle speed.

16 Claims, 3 Drawing Sheets

METHOD TO ELEVATE IDLE SPEED TO LAUNCH A VEHICLE WITH MANUAL TRANSMISSION

CROSS-REFERENCE TO RELATED APPLICATION

This application is a continuation of U.S. patent application Ser. No. 15/170,599, filed Jun. 1, 2016, the entire disclosure of which is incorporated by reference herein.

BACKGROUND

When a running vehicle is stationary, such as at a stop sign or traffic light, the vehicle operator will often place the vehicle transmission in neutral or engages the clutch and release the throttle pedal (accelerator). With the engine uncoupled from the drivetrain and the throttle pedal released, the engine of the vehicle operates at a predetermined base idle speed, typically measured in revolutions per minute and controlled by an engine idle speed governor. Idle speed governors are normally configured to maintain a base idle speed in order to allow the engine to run on its own without any external intervention and comply with regulatory fuel consumption and emissions standards. In this regard, some idle speed governors use control loop feedback controllers with feedforward input from auxiliary components to control the fuel provided to the engine in order to regulate engine speed.

To launch a vehicle with a manual transmission from a stationary position, the operator first; applies the service brake, releases the parking brake, engages the clutch and puts the transmission in gear. Second; the operator slowly releases the clutch and service brake to launch the vehicle. For heavy-duty vehicles, such as trucks, it is desirable to launch the vehicle from the stationary position without having to press the throttle pedal, i.e., to launch "unassisted." During some conditions, such as when the truck is heavily loaded or stopped on an uphill incline, the idling engine does not provide enough torque to allow for a smooth unassisted launch. As a result, the vehicle may lurch or the engine may stall—unless the driver intervenes. Driver intervention is a wholly undesirable characteristic of having to launch a vehicle.

SUMMARY

The disclosed methods prevent engine stall and lurching during a vehicle launch by automatically elevating the engine idle speed under certain conditions. Fully loaded manual transmission equipped trucks with low base idle speeds positioned on an uphill grade typically cannot launch in 1$^{st}$ gear without the driver applying the throttle to increase torque. By automatically elevating the engine idle speed, additional torque is made available for a smooth and (driver) unassisted launch.

In one representative embodiment, a computer implemented method controls an idle speed for an engine of a vehicle. The method includes the steps of sensing a vehicle speed, sensing a parking brake position, and sensing a clutch position. The method further includes the step of increasing the idle speed from a base idle speed to a launch idle speed when the vehicle speed is below a maximum vehicle speed, the parking brake is released, and the clutch is depressed.

In a second representative embodiment, a computer implemented method includes the step of determining for a vehicle, a vehicle speed, a parking brake position, and a clutch position. The method further includes the step of initiating an engine idle speed increase based at least in part on the vehicle speed, the parking brake position, and the clutch position. When certain criteria are met, the increased idle speed is reduced back down to the base idle speed. The idle speed reduction is preferably accomplished by an exponential decaying function that gradually phases out the increased idle speed.

In a third representative embodiment, an on-board vehicle computer system includes at least one processing unit and a memory having computer-executable instructions configured to cause the on-board vehicle computer system to perform steps. The steps include determining for a vehicle, a vehicle speed, a parking brake position, and a clutch position. The steps further include initiating an engine idle speed increase based at least in part on the vehicle speed, the engine speed, the parking brake position, and the clutch position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended only as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

The following description proceeds with reference to examples of computer systems and methods suitable for use in vehicles, such as Class 8 trucks. Although illustrative embodiments of the present disclosure will be described hereinafter with reference to trucks, it will be appreciated that aspects of the present disclosure have wide application, and therefore, may be suitable for use with many types of vehicles, such as passenger vehicles, buses, commercial vehicles, light and medium duty vehicles, etc.

It should be understood that various embodiments of the present disclosure include logic and operations performed by electronic components. These electronic components, which may be grouped in a single location or distributed over a wide area, generally include processors, memory, storage devices, display devices, input devices, etc. It will be appreciated by one skilled in the art that the logic described herein may be implemented in a variety of hardware, software, and combination hardware/software configurations, including but not limited to, analog circuitry, digital circuitry, processing units, and the like. In circumstances where the components are distributed, the components are accessible to each other via communication links. A controller area network (CAN) bus can be used to communicate vehicle operating conditions as specified by the Society of Automotive Engineers (SAE) J1939 standard.

Figure 1:
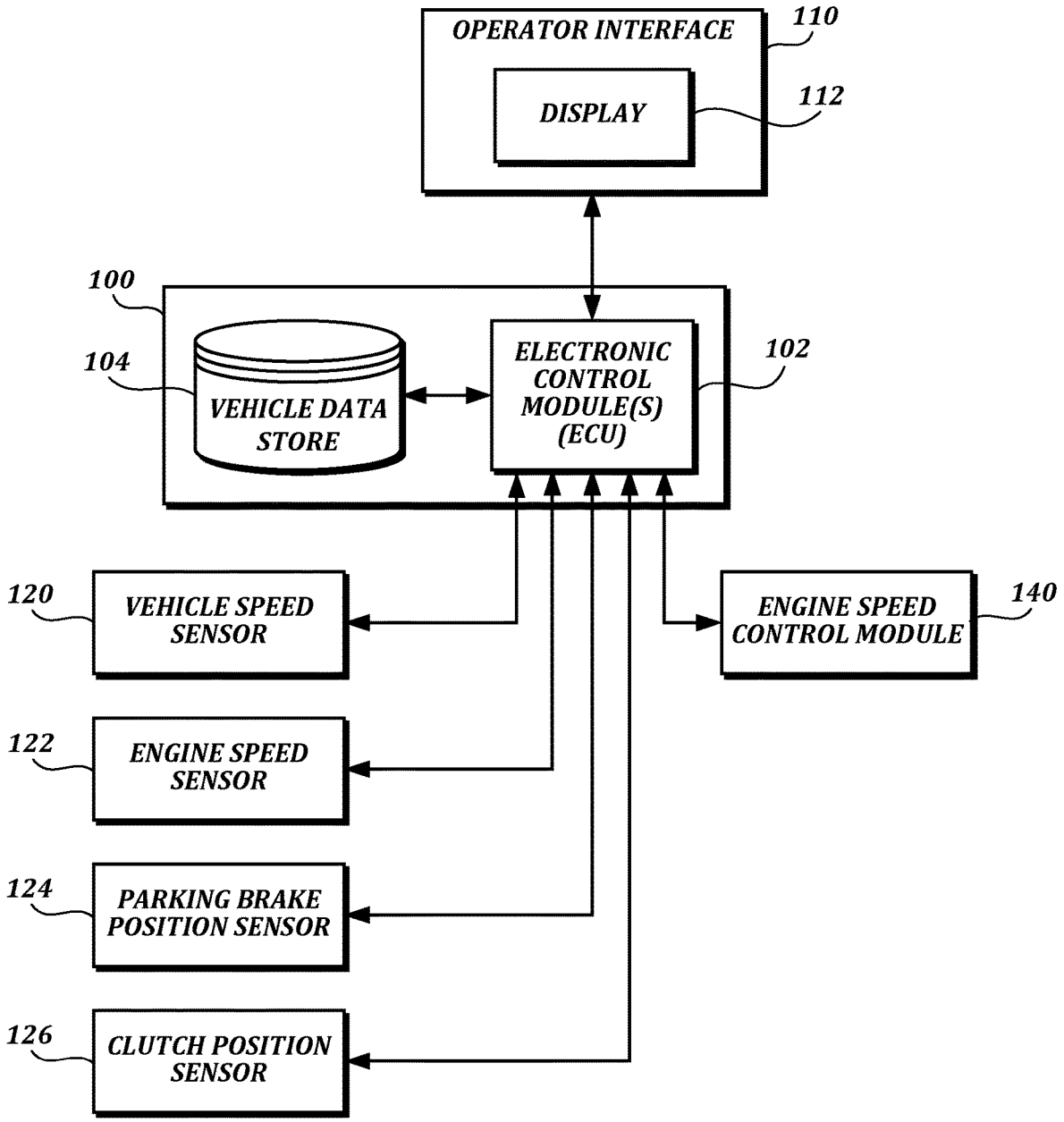
FIG. 1 is a schematic diagram of an illustrative on-board vehicle computing system comprising an engine idle launch speed control system.

FIG. 1 illustrates one embodiment of an engine idle launch speed control system 100 of a vehicle according to various aspects of the present disclosure. The system 100 includes at least one electronic control unit (ECU) 102 that, among other functions, monitors vehicle status, communicates with various control modules, and causes operator notifications to be generated when appropriate. The system communicates with an operator interface 110 comprising an operator display 112. The operator display 112 may be any type of display used in a vehicle to convey information (e.g., idle speed control notifications) to the operator. For example, the operator display 112 may include an LCD display configured to display information to the operator much like any other computing display. As another example, the operator display 112 may include special purpose lighted displays, needle gauges, and/or the like. The operator interface 110 also may include other output devices such as speakers or haptic feedback devices to provide information to the operator. In a touchscreen configuration, the operator display 112 may have input capabilities. The operator interface 110 also may include other input devices including buttons, toggles, keyboards, mechanical levers, and any other devices that allow an operator to provide input to the ECU 102.

It will be appreciated that the ECU 102 can be implemented in a variety of hardware, software, and combination hardware/software configurations, for carrying out aspects of the present disclosure. For example, the ECU 102 may include memory and a processor. In one embodiment, the memory comprises a random access memory ("RAM") and an electronically erasable, programmable, read-only memory ("EEPROM") or other non-volatile memory (e.g., flash memory) or persistent storage. The RAM may be a volatile form of memory for storing program instructions that are accessible by the processor. The processor is configured to operate in accordance with program instructions. The memory may include program modules, applications, instructions, and/or the like that are executable by the processor. In particular, the memory may include program instructions that implement functionality of the engine idle launch speed control system 100.

The ECU 102 is communicatively coupled to a plurality of sensors 120-126 that provide information concerning the status of the vehicle. For example, in a disclosed embodiment, the ECU 102 is communicatively coupled to a vehicle speed sensor 120, an engine speed sensor 122, a parking brake position sensor 124, and a clutch position sensor 126 configured to provide real-time data about corresponding subsystems of the vehicle.

In the illustrated embodiment, the vehicle speed sensor 120 measures the speed of the vehicle, directly or indirectly. Similarly, the engine speed sensor 122 measures the speed of the engine, directly or indirectly. Both the vehicle speed sensor 120 and the engine speed sensor 122 send signals indicating the vehicle speed and the engine speed, respectively, to the ECU 102.

The parking brake position sensor 124 detects whether or not the parking brake is set and sends a corresponding signal to the ECU 102. The clutch position sensor 126 includes a switch that is engaged when the clutch is depressed and disengaged when the clutch is released. The switch enables to clutch position sensor 126 to sense the position of the clutch and send a corresponding signal to the ECU 102.

It will be appreciated that the described sensors are exemplary and should not be considered limiting. In this regard, alternate sensor configurations can be utilized to sense, directly or indirectly, the vehicle speed, engine speed, parking brake position, and clutch position, and send corresponding signals to the ECU 102. The implementation of one or more alternate sensors is contemplated and should be considered within the scope of the present disclosure.

The ECU 102 is communicatively coupled to an engine speed control module 140. In the illustrated embodiment, the engine speed control module 140 is a governor in the form of a discrete-time PI controller. The engine speed control module 140 controls the amount of fuel delivered to the engine to regulate actual engine speed.

The vehicle includes other control modules (not shown) such as a vehicle speed control module and an engine torque control module. In one embodiment, the modules (which can be collectively referred to as vehicle performance control modules) electronically control vehicle operating parameters, such as maximum engine speed, vehicle speed, engine torque, etc., according to input received from the ECU 102. Electronic control modules for controlling engine speed, vehicle speed, and engine torque are known in the art, and the present disclosure is not limited to any particular control module. The vehicle performance control modules can be used to control vehicle performance in accordance with the described engine idle launch speed control system 100.

The illustrated ECU 102 is also communicatively coupled to a vehicle data store 104 with launch engine idle speed data. The vehicle data store 104 includes a computer-readable storage medium. Any suitable nonvolatile computer-readable storage medium, such as an EEPROM, flash memory, hard disk, or the like may be used. In one embodiment, the sensed vehicle operating conditions are used by the engine idle launch speed control system 100, as described herein, to perform one or more of the functions described herein. For example, the description makes reference to vehicle data that can be sensed and stored during vehicle operation, as well as programmable settings that can be programmed by the vehicle manufacturer, the owner, the operator, or any other suitable entity.

Components described herein may be communicatively coupled by any suitable means. In one embodiment, components may be connected by an internal communications network such as a vehicle bus that uses a controller area network (CAN) protocol, a local interconnect network (LIN) protocol, and/or the like. Those of ordinary skill in the art will recognize that the vehicle bus may be implemented using any number of different communication protocols such as, but not limited to, Society of Automotive Engineers ("SAE") J1587, SAE J1922, SAE J1939, SAE J1708, and combinations thereof. In other embodiments, components may be connected by other networking protocols, such as Ethernet, Bluetooth, TCP/IP, and/or the like. In still other embodiments, components may be directly connected to each other without the use of a vehicle bus, such as by direct wired connections between the components. Embodiments of the present disclosure may be implemented using other types of currently existing or yet-to-be-developed in-vehicle communication systems without departing from the scope of the claimed subject matter.

Still referring to FIG. 1, operation of the exemplary embodiment of the of the engine idle launch speed control system 100 will be described, wherein the certain terms used in the description are defined as follows:

- Clutch_sw=Signal from the clutch switch–clutch pressed=TRUE, clutch released=FALSE;
- Espd_idle=Reference or base engine idle speed (idle target without launch control active);
- Espd_trgt=Calibratable value that determines the launch engine speed;
- EXP=Calibratable exponent (controls decay rate and shape);
- Park_sw=Signal from the parking brake–brake set=TRUE, brake not set=FALSE);
- Vspad=Vehicle speed measurement parameter;
- Vspd_max=Calibratable value that determines the maximum vehicle speed in which launch control will stay active; and
- Vspd_min=Calibratable value that determines the minimum vehicle speed in which the vehicle must be below to enable launch control.

The engine idle launch speed control system 100 operates to increase the idle speed of a vehicle temporarily during a launch. Prior to launch, the vehicle is in a stationary position with clutch released, the transmission in neutral, and the parking brake engaged. When the vehicle is in this "neutral idle state," the engine speed control module 140 maintains the engine idle speed at the base engine idle speed (Espd_idle).

To launch the vehicle from a stationary neutral idle state, the vehicle operator engages the clutch, puts the vehicle in gear, releases the parking brake, and then releases the clutch. When the operator engages the clutch and releases the parking brake, the clutch position sensor 126 and the parking brake position sensor 124 send signals to the ECU 102 indicating the following vehicle conditions, respectively:

$$\text{Clutch_sw}==\text{TRUE} \tag{1}$$

$$\text{Park_sw}==\text{FALSE} \tag{2}$$

At the same time, the vehicle speed sensor 120 senses the speed of the vehicle and sends a signal to the ECU 102 indicating whether the vehicle speed Vspd is equal to or below a minimum vehicle speed Vspd_min required as a precondition to increase the base idle speed Espd_idle to a launch idle speed Espd_trgt. The minimum vehicle speed Vspd_min is typically in a range of 0-5 mph, however, it will be appreciated that the Vspd_min can be calibrated according to vehicle characteristics, operating conditions, desired vehicle performance, and other factors. Accordingly, it will be appreciated that the minimum vehicle speed Vspd_min can vary, and such variations should be considered within the scope of the present disclosure. The ECU 102 receives signals regarding the vehicle speed Vsp from the vehicle speed sensor 120 and determines when the following condition is met:

$$\text{Vspd} \leq \text{Vpsd_min} \tag{3}$$

With the three identified conditions being met (clutch depressed, parking brake released, and vehicle speed at or below a predetermined minimum), the launch engine idle speed is enabled. As a result, the engine speed control module 140 increases the engine speed from the base idle speed Espd_idle to a launch idle speed Espd_trgt. In the illustrated embodiment, the launch idle speed Espd_trgt is a set point based on the base engine idle speed E_spd, a predetermined target engine speed Espd_trgt, the vehicle speed Vspd, and the maximum vehicle speed in which launch control will stay active Vspd_max. Specifically, the set point is determined according to the following formula:

$$\min\left[\text{Espd_trgt}, \left(\text{Espd_trgt} - \left[\left(\left[\frac{\min(Vspd, \text{Vspd_max})}{\max(\text{Vspd_max}, 1)}\right]^{EXP}\right) \times (\text{Espd_trgt} - \text{Espd_idle})\right]\right)\right] \tag{4}$$

It will be appreciated that the disclosed formula for determining the engine speed set point is exemplary only, and should not be considered limiting. In this regard, the set point can be a specific predetermined engine speed or can be based on different operating characteristics and according to different criteria. These and other ways to determine the engine speed set point are contemplated and should be considered within the scope of the present disclosure.

The increased idle speed enables the vehicle to launch from a stationary neutral idle state, requiring additional throttle from the operator. Moreover, the increased idle prevents or minimizes rough starts and stalls due to insufficient engine torque when the vehicle is heavily loaded or facing uphill on an incline.

With the vehicle launched, the engine idle launch speed control system 100 remains engaged until at least one of two conditions is met. One condition is that the vehicle speed Vspd has reached or exceeded a predetermined maximum vehicle speed Vspd_max. Another condition is that the clutch has been depressed, indicating that the driver is about to upshift or put the vehicle back in neutral to stop. Accordingly, when the ECU receives a signal from either the vehicle speed sensor 120 or the clutch position sensor 126 indicating either condition shown below in equations (5) and (6) is true, the launch control is disabled, and the engine idle returns from the launch idle speed Espd_trgt to the base idle speed Espd_idle.

$$\text{Vspd} \geq \text{Vspd_max} \tag{5}$$

$$\text{Clutch_sw}==\text{FALSE} \tag{6}$$

To ensure a smooth transition from the launch idle speed Espd_trgt back to the base idle speed Espd_idle, the elevated engine speed is "phased out" according to a decaying exponential function. This function is based upon the actual vehicle speed and launch control activation criteria. It will be appreciated that the activation criteria and the decay function can be calibrated to allow for a steady and unaided launch that is transparent to the driver, with the exception of the slightly elevated idle upon activation of the launch engine idle speed.

Figure 2:
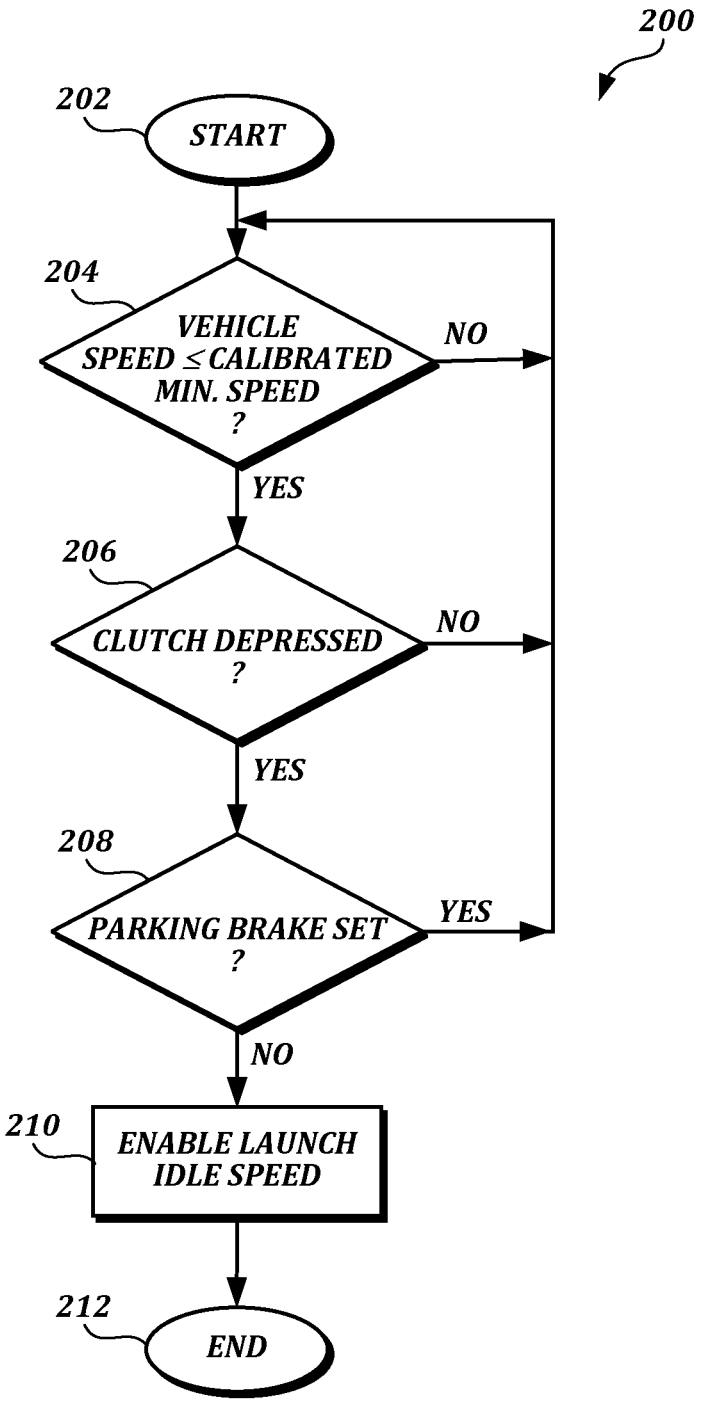
FIG. 2 is a flow chart illustrating a representative method for enabling a launch engine idle speed according to the present disclosure.

Referring now to FIG. 2, an exemplary process 200 for enabling a launch engine idle speed will now be described. In this regard, process 200 increases the engine idle speed from a base engine idle speed (Espd_idle) to a launch engine idle speed (Espd_trgt). The process starts at step 202 with the engine idle speed at the base engine idle speed (Espd_idle) and then proceeds to step 204.

In step 204, the actual vehicle speed (Vspd) is compared to the minimum vehicle speed (Vspd_min), which the vehicle must be at or below in order to enable launch engine idle speed. If Vspd is greater than Vspd_min, then the process remains at step 204. If Vspd is less than or equal to Vspd_min, then the process proceeds to step 206.

In step 206, the position of the clutch is determined. More specifically, the ECU 102 processes the signal received from the clutch position sensor 126. If the signal indicates that the clutch is released, i.e., not depressed, then the process 200 returns to step 204. If the signal indicates that the clutch is depressed, then the process 200 proceeds to step 208.

In step 208, the engagement of the parking brake is determined. In this regard, the ECU 102 processes the signal received from the parking brake sensor 124. If the signal indicates that the parking brake is set, the process 200 returns to step 204. If the signal indicates that the parking brake is released, the process 200 proceeds to step 210, and the launch engine idle speed is enabled. In this regards, the ECU 102 communicates with the engine speed control module 140 to increase the engine idle speed from the base engine idle speed (Espd_idle) to the launch engine idle speed (Espd_trgt).

With the launch engine idle speed enabled, the process 200 proceeds to step 212, and the process 200 for enabling a launch engine idle speed ends.

Figure 3:
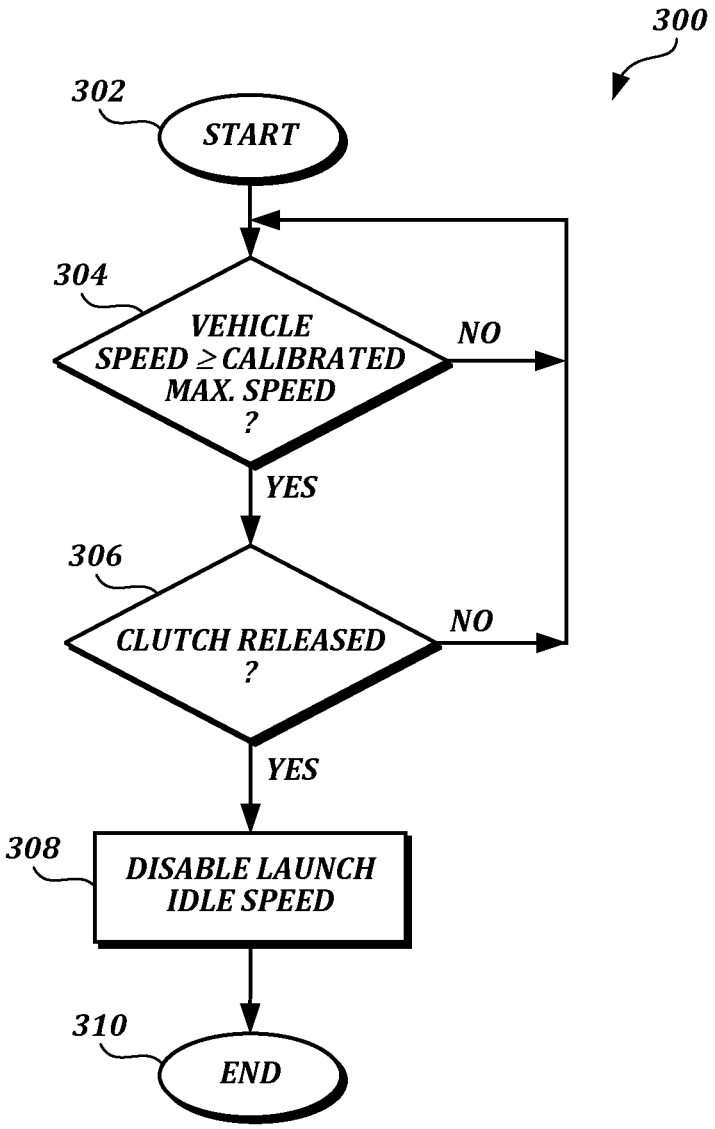
FIG. 3 is a flow chart illustrating a representative method for disabling the launch engine idle speed according to the present disclosure.

Referring now to FIG. 3, a process 300 for resetting the launch engine idle speed, i.e., reducing engine idle from a launch engine idle speed (Espd_trgt) to a base engine idle speed (Espd_idle), will be described. The process starts at step 302 with the engine idle speed at the launch engine idle speed (Espd_trgt) and then proceeds to step 304.

In step 304, the actual vehicle speed (Vspd) is compared to the maximum vehicle speed (Vspd_max) at which the launch engine idle speed is intended to be maintained. If Vspd is less than Vspd_max, then the process remains at step 302. If Vspd is greater than or equal to Vspd_max, then the process proceeds to step 306.

In step 306, the position of the clutch is determined. The ECU 102 processes the signal received from the clutch position sensor 126. If the signal indicates that the clutch is depressed, then the process 300 returns to step 304. If the signal indicates that the clutch is released, then the process 300 proceeds to step 308.

In step 308, the launch engine idle speed is disabled such that the engine idle speed is reduced from the launch engine idle speed (Espd_trgt) to the base engine idle speed (Espd_idle). As previously described, the idle speed is preferably reduced utilizing an exponential decaying function that gradually phases out the elevated idle speed. It will be appreciated, however, that the idle speed reduction can have different profiles, i.e., can be the result of different reduction functions, and such functions are contemplated and should be considered within the scope of the present disclosure.

The disclosed engine idle launch speed control system 100 is advantageous in that it provides for steady and unaided launch from a stationary idle condition. Further, the control system allows for a lower base engine idle speed when activating conditions are not met; consequently decreasing fuel consumption with emissions.

While illustrative embodiments have been illustrated and described, it will be appreciated that various changes can be made therein without departing from the spirit and scope of the invention.

The embodiments of the invention in which an exclusive property or privilege is claimed are defined as follows:

1. A vehicle computer system, comprising:

at least one processing unit; and a memory, operatively connected to the at least one processing unit and storing computer-executable instructions that, when executed by the at least one processing unit, cause the vehicle computer system to perform steps comprising:

determining for a vehicle, a vehicle speed, an engine speed, a clutch position, and a brake position; and initiating an engine idle speed increase based at least in part on the vehicle speed, the clutch position, and the brake position, wherein the step of initiating the engine idle speed increase is based at least in part on the vehicle speed being less than a predetermined maximum speed.

2. The system of claim 1, wherein the step of initiating the engine idle speed increase is based at least in part on the brake being released.

3. The system of claim 1, wherein the system further performs the step of initiating an engine idle speed decrease when the vehicle speed exceeds a predetermined maximum speed.

4. A method of initiating an engine idle speed increase, comprising executing the instructions of the system of claim 1.

5. The system of claim 1, wherein initiating an engine idle speed increase comprises increasing the engine idle speed to a launch engine idle speed, and wherein the launch engine idle speed is a predetermined engine speed.

6. The system of claim 1, wherein initiating an engine idle speed increase comprises increasing the engine idle speed to a launch engine idle speed, and wherein the launch engine idle speed comprises a set point based on a base engine idle speed and a predetermined target launch engine idle speed.

7. A nontransitory computer-readable medium having computer-executable instructions stored thereon that, when executed by one or more processors of a computing device, cause the computing device to perform actions for initiating an engine idle speed increase, the actions comprising:

sensing a vehicle speed;

sensing a brake position; and increasing the idle speed from a base engine idle speed to a launch engine idle speed when the vehicle speed is below a maximum vehicle speed and the brake position moves from an engaged position to a released position, wherein the launch engine idle speed is a predetermined engine speed.

8. The computer-readable medium of claim 7, wherein the actions further comprise the step of decreasing the engine idle speed from the launch engine idle speed to the base engine idle speed.

9. The computer-readable medium of 8, wherein the engine idle speed is decreased from the launch engine idle speed to the base engine idle speed when the vehicle speed exceeds a maximum value.

10. The computer-readable medium of 7, wherein the brake is a parking brake.

11. A method of initiating an engine idle speed increase, comprising executing the computer-executable instructions of claim 7.

12. The nontransitory computer-readable medium of claim 7, wherein the actions further comprise: sensing a clutch position, and wherein increasing the idle speed from the base engine idle speed to the launch engine idle speed is further based on the clutch position.

13. An on-board vehicle computer system, comprising:

at least one processing unit; and a memory, operatively connected to the at least one processing unit and storing computer-executable instructions that, when executed by the at least one processing unit, cause the on-board vehicle computer system to perform steps comprising:

determining for a vehicle, a vehicle speed and a parking brake position;

initiating an engine idle speed increase based at least in part on the vehicle speed and the parking brake position, and initiating an engine idle speed decrease based on the vehicle speed, wherein the engine idle speed decrease is defined by an exponential decay from an elevated engine idle speed to a base engine idle speed.

14. The system of claim 13, wherein the step of initiating the engine idle speed increase is based at least in part on the parking brake being released.

15. The system of claim 13, further comprising the step of initiating an engine idle speed decrease when the vehicle speed exceeds a predetermined maximum speed.

16. A method of initiating an engine idle speed increase, comprising executing the computer-executable instructions of claim 13.

* * * * *